US007357597B2

(12) United States Patent
Face, III et al.

(10) Patent No.: US 7,357,597 B2
(45) Date of Patent: Apr. 15, 2008

(54) CONCRETE SCREED WITH MOVABLE LEADING EDGE

(75) Inventors: S. Allen Face, III, Wilmington, NC (US); Albert D. Frankeny, II, Round Hill, VA (US)

(73) Assignee: Laser Strike LLC, Wilmington, NC (US)

( * ) Notice: Subject to any disclaimer, the term of this patent is extended or adjusted under 35 U.S.C. 154(b) by 231 days.

(21) Appl. No.: 11/294,270

(22) Filed: Dec. 5, 2005

(65) Prior Publication Data

US 2006/0257207 A1 Nov. 16, 2006

Related U.S. Application Data

(63) Continuation-in-part of application No. 11/126,632, filed on May 11, 2005.

(51) Int. Cl.

| | |
|---|---|
| ***E01C 23/07*** | (2006.01) |
| ***E01C 19/22*** | (2006.01) |
| ***E01C 19/42*** | (2006.01) |
| *E01C 23/00* | (2006.01) |

(52) U.S. Cl. ..... 404/118

(58) Field of Classification Search ..... 404/118, 404/83, 84.1

See application file for complete search history.

(56) References Cited

U.S. PATENT DOCUMENTS

| | | | | |
|---|---|---|---|---|
| 4,861,188 | A * | 8/1989 | Rouillard | 404/75 |
| 5,549,413 | A * | 8/1996 | Bolden | 404/93 |
| 6,089,787 | A * | 7/2000 | Allen et al. | 404/118 |
| 6,379,080 | B1 | 4/2002 | Saffo, Sr. | |
| 6,779,945 | B2 | 8/2004 | Saffo, Sr. | |
| 6,923,595 | B1 * | 8/2005 | Chek | 404/118 |
| 6,953,304 | B2 * | 10/2005 | Quenzi et al. | 404/114 |
| 6,976,805 | B2 * | 12/2005 | Quenzi et al. | 404/114 |
| 7,195,423 | B2 * | 3/2007 | Halonen et al. | 404/84.5 |

* cited by examiner

*Primary Examiner*—Raymond W Addie
(74) *Attorney, Agent, or Firm*—Peter J. Van Bergen

(57) ABSTRACT

A floating screed device has an elongated float and an elongated blade movably coupled to the elongated float so that the blade is freely movable in pitch.

11 Claims, 4 Drawing Sheets

CONCRETE SCREED WITH MOVABLE LEADING EDGE

This is a continuation-in-part of co-pending application Ser. No. 11/126,632, filed May 11, 2005. Pursuant to 35 U.S.C. §120, the benefit of priority from co-pending application Ser. No. 11/126,632 is hereby claimed for this application.

FIELD OF THE INVENTION

The invention relates generally to screeding devices, and more particularly to a floating screed device that has a movable leading edge.

BACKGROUND OF THE INVENTION

Floating screeds are used to strike off and finish concrete floors or other horizontal surfaces. In general, a floating screed has a heavy planar float with an elongated edge defining a blade. The blade forms the leading edge of the screed that cuts through a volume of plastic concrete as the screed is pulled therethrough. Excess concrete that builds up on the blade side of the screed is raked away by workers standing in the unfinished concrete. As the float moves over an area of the concrete cut by the blade, the float serves to smooth the concrete thereby leaving a finished region of concrete that should be smooth, level, and at a specified elevation.

To achieve the desired elevation, the screed operator is constantly pushing down or pulling up on the screed to adjust the position of the screed's blade edge. However, prior art screeds link the screed's blade edge and float such that the pitch of the float tends to track the pitch of the blade edge which can affect the pitch and target elevation of the finished region of concrete. For example, linking of the blade edge and float is typically accomplished by means of well known rigid couplings or by means of stiff, resilient couplings such as those described in U.S. Pat. Nos. 6,379,080 and 6,779,945. Furthermore, since the blade edge and float are rigidly or resiliently linked, the screed operator's efforts required to change pitch can be substantial.

SUMMARY OF THE INVENTION

Accordingly, it is an object of the present invention to provide a floating screed device that can be controlled to produce smooth and level concrete surfaces at a desired elevation.

Other objects and advantages of the present invention will become more obvious hereinafter in the specification and drawings.

In accordance with the present invention, a floating screed device has an elongated float for floating on plastic concrete and an elongated blade movably coupled to the elongated float. The elongated blade is freely movable in pitch relative to the float as the elongated float floats on the plastic concrete.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DETAILED DESCRIPTION OF THE INVENTION

Figure 1:
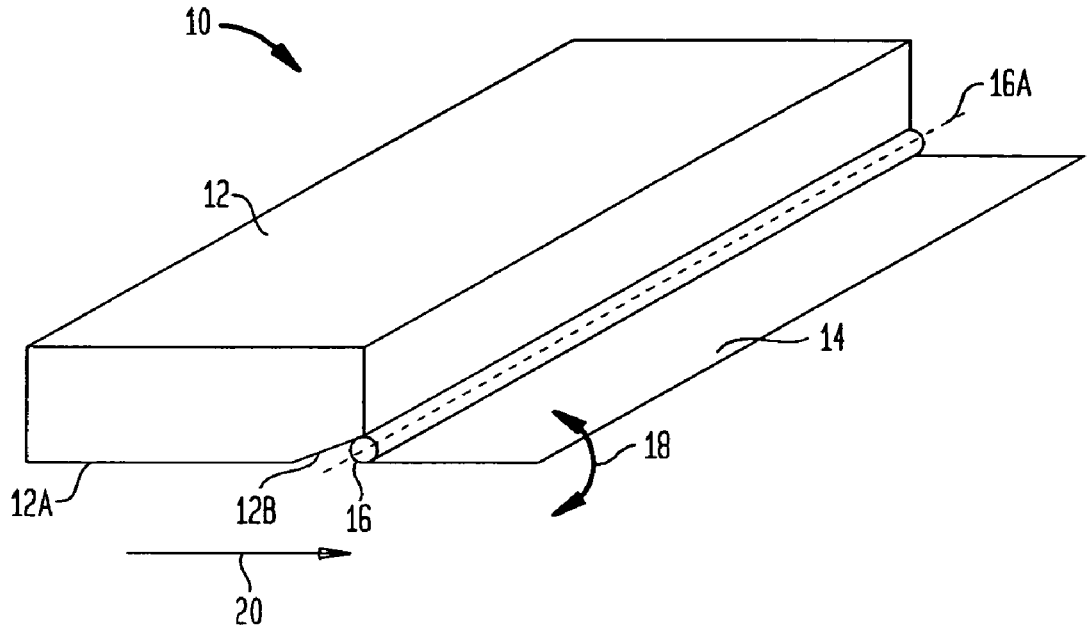
FIG. 1 is a perspective view of a floating screed device according to an embodiment of the present invention.

Referring now to the drawings, and more particularly to FIG. 1, an embodiment of a floating screed device in accordance with the present invention is shown and is referenced generally by numeral 10. Floating screed device 10 is an elongate device as would be well understood in the art. Floating screed device 10 includes an elongate float 12, an elongate blade 14 and a hinge 16 that allows blade 14 to freely pivot about the longitudinal axis 16A of hinge 16 as indicated by a two-headed arrow 18. Thus, when a planar bottom 12A of float 12 is floating on a plastic concrete surface (not shown) to be finished, blade 14 is movable in pitch as floating screed device 10 is pulled over the concrete surface in the direction of arrow 20. In this configuration, blade 14 defines the leading edge of floating screed device 10.

Because hinge 16 provides unrestricted movement of blade 14 in pitch relative to float 12, there is no moment connection between blade 14 and float 12. Note that the viscous nature and weight of plastic concrete is such that movement of blade 14 therein applies forces thereto. However, the mass of float 12 is typically much greater than that of blade 14. The greater mass of float 12 combined with the fact that there is no moment connection between blade 14 and float 12 means that the forces applied to blade 14 by the plastic concrete have minimal impact on the orientation of float 12 and, therefore, the orientation of planar bottom 12A on the plastic concrete.

It is to be understood that the design and/or shape of float 12, blade 14 and hinge 16 are not limitations of the present invention. For example, float 12 can be substantially rectangular in cross-section (as shown) having a beveled, lower leading edge 12B to facilitate movement over concrete. However, float 12 could be defined by other geometric shapes without departing from the scope of the present invention. Float 12 could be hollow, solid, or filled with a granular material, a solid material or a fluid. With respect to blade 14, its shape and construction details can be any shape that would allow blade 14 to cut through plastic concrete as floating screed device 10 was moved along direction 20. With respect to hinge 16, its design and construction can be any that would permit free movement of blade 14 in pitch 18 relative to float 12. Hinge 16 could be a continuous element or discrete elements positioned along the lengths of float 12 and blade 14. Further, hinge 16 could be a hardware element or a flexible, non-resilient coupling that permitted free movement in pitch 18.

Figure 2:
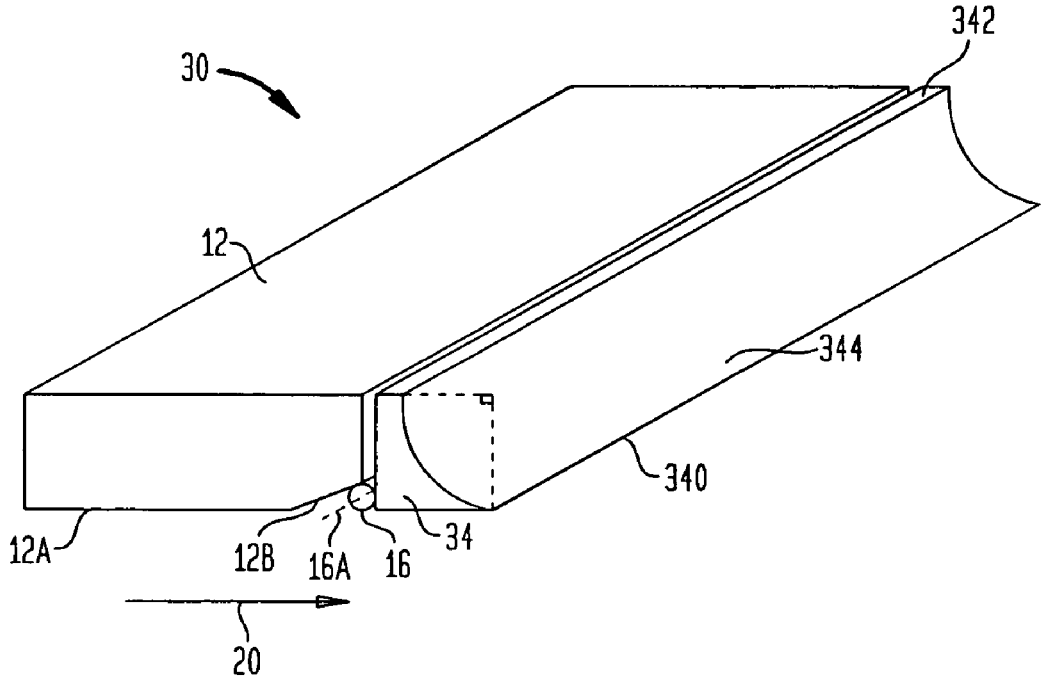
FIG. 2 is a perspective view of a floating screed device according to another embodiment of the present invention.

Referring now to FIG. 2, another embodiment of a floating screed device in accordance with the present invention is shown and is referred generally by numeral 30. Floating screed device 30 again includes float 12 and hinge 16, both of which function as described above. However, device 30 differs from device 10 in that blade 34 (movably coupled to float 12 by hinge 16) facilitates the screeding operation by its unique design. More specifically, blade 34 has the following unique design features:

(i) an elongate leading edge 340 that forms the initial contact or cutting edge of floating screed device 30 as it moves on/through plastic concrete in direction 20, (ii) a top 342 that is planar, and (iii) an arcuate face 344 defined between leading edge 340 and top 342.

For reasons that will be explained further below, arcuate face 344 should define a smooth and gently curved surface with the portion thereof near top 342 being substantially vertical when blade 34 is resting on a concrete surface. For example, the shape of arcuate face 344 can be defined by a circular arc of 90° as shown, although angles between approximately 85-90° can be used. Again, for reasons that will be explained further below, arc angles greater than 90° should be avoided.

Figure 3A:
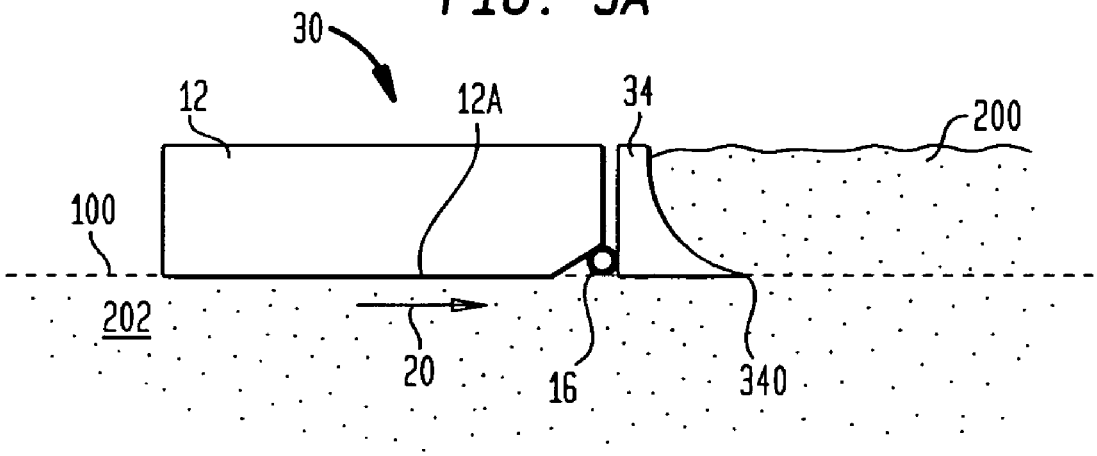
FIG. 3A is a side schematic view of the floating screed device of FIG. 2 operating at a target elevation.

The present invention improves the screeding operation as the floating screed device is more easily manipulated to a finished-concrete target elevation. To illustrate operation of the present invention, reference will now be made to FIGS. 3A-3C where a target elevation for a finished concrete surface is illustrated by dashed line 100. In general, target elevation 100 refers to a datum (e.g., typically a locally horizontal datum) that defines what should be the finished concrete surface. For purpose of illustration, operations will be described using floating screed device 30 moving in direction 20. Relative to direction 20, an unfinished volume of plastic concrete 200 is forward of device 30 while finished concrete 202 trails device 30. Volume 200 is typically at a height above target elevation 100 so that blade 34 must cut therethrough.

In use, whatever the orientation of bottom 12A of float 12 (i.e., horizontal, tilted, at target elevation 100, or above/below target elevation 100), leading edge 340 of blade 34 is kept at target elevation 100. For example, floating screed device 30 is "on grade" (i.e., bottom 12A of float 12 is at target elevation 100) in FIG. 3A and leading edge 340 of blade 34 is kept at target elevation 100 as shown.

Figure 3B:
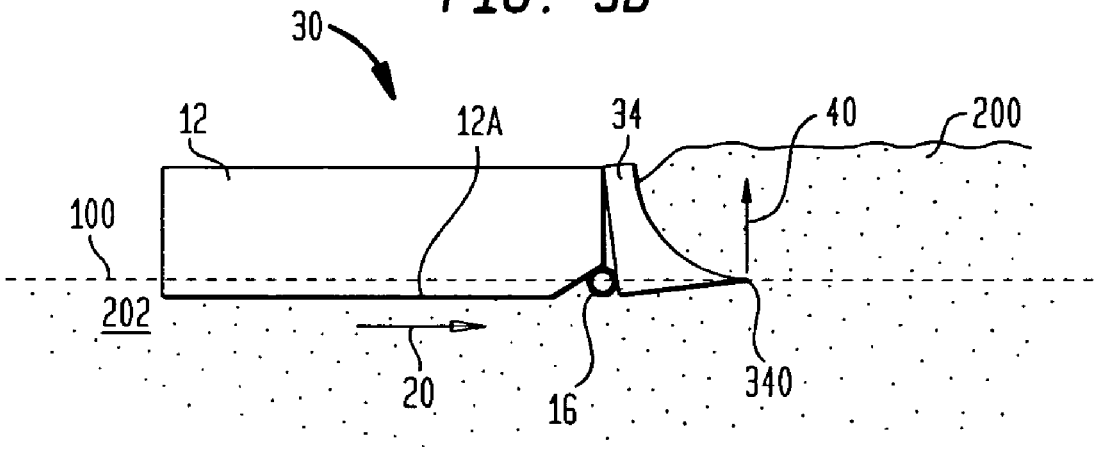
FIG. 3B is a side schematic view of the floating screed device of FIG. 2 operating below a target elevation.

In FIG. 3B, bottom 12A of float 12 is below target elevation 100. The following sequence of operations are used to put device 30 back on grade. First, blade 34 is pitched or tilted up as illustrated (by application of a force represented by arrow 40) to position leading edge 340 at target elevation 100. As device 30 advances in direction 20, float 12 pitches up as it encounters an uphill slope in the concrete created by the upwardly-tilted blade 34. Then, as float 12 (now inclining upward) climbs uphill, blade 34 is rotated/tilted downward (relative to float 12) in order to keep leading edge 340 at target elevation 100. In response, float 12 pitches down to follow the concrete profile created by blade 34. Blade 34 is then rotated/tilted upward again (relative to float 12) to keep leading edge 340 at target elevation 100. The above-described continuous rotation/tilting of blade 34 (to keep leading edge 340 at target elevation 100) as float 12 changes elevation and inclination will, during the course of travel of device 30, horizontally align bottom 12A and blade 34 at target elevation 100.

Figure 3C:
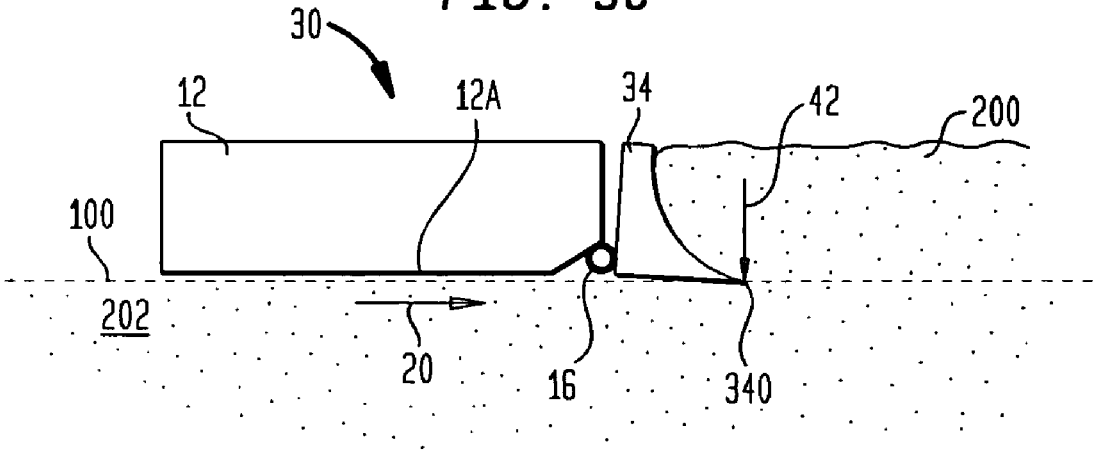
FIG. 3C is a side schematic view of the floating screed device of FIG. 2 operating above a target elevation.

For the situation defined by bottom 12A of float 12 being above target elevation 100 as illustrated in FIG. 3C, the following sequence of operations are used to put device 30 back on grade. First, blade 34 is pitched or tilted down as illustrated (by application of a force represented by arrow 42) to position leading edge 340 at target elevation 100. As device 30 advances in direction 20, float 12 pitches down as it encounters a downhill slope in the concrete created by the downwardly-tilted blade 34. Then, as float 12 (now inclining downward) descends downhill, blade 34 is rotated/tilted upward (relative to float 12) in order to keep leading edge 340 at target elevation 100. In response, float 12 pitches up to follow the concrete profile created by blade 34. Blade 34 is then rotated/tilted downward again (relative to float 12) to keep leading edge 340 at target elevation 100. Once again, the above-described continuous rotation/tilting of blade 34 (to keep leading edge 340 at target elevation 100) as float 12 changes elevation and inclination will, during the course of travel of device 30, horizontally align bottom 12A and blade 34 at target elevation 100.

Figure 4:
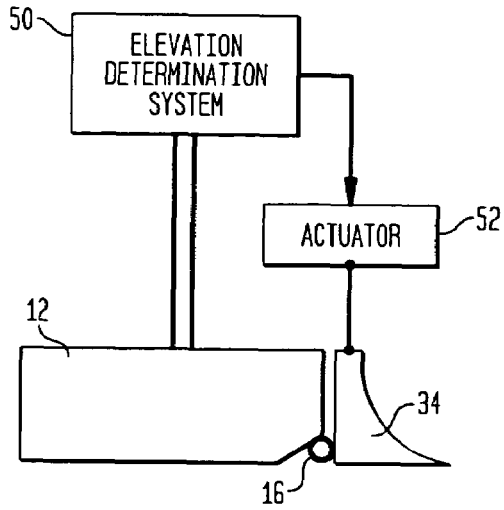
FIG. 4 is a side schematic view of the floating screed device of FIG. 2 further equipped with a system for adjusting the pitch of the screed device's movable blade.

The application of forces 40 (FIG. 3B) and 42 (FIG. 3C) can be automated. An example of such automation is illustrated in FIG. 4 where an elevation determination system 50 is mounted to float 12. For example, system 50 can be part of a laser level system, the use of which in concrete floor construction is well known and understood. In general, elevation determination system 50 determines the height of float 12 (e.g., bottom 12A of float 12) relative to a target height (i.e., target elevation 100). The output of system 50 is an amount of pitch that blade 34 must be moved to achieve the target height as floating screed device 30 is moved. An actuator 52 is coupled to system 50 and blade 34, and is used to apply the requisite amount of up or down force to blade 34 to bring about the necessary amount of blade pitch as blade 34 pivots about hinge 16.

With elevation determination system 50 mounted on float 12, it is critical that the orientation of float 12 is not affected when blade 34 pivots in pitch in order to minimize the introduction of elevation errors. As explained previously, change in pitch of blade 34 has minimal effect on the orientation of the bottom 12A of float 12 owing substantially to the freely pivoting action provided by hinge 16. Furthermore, forces 40 or 42 need only be sufficient to keep leading edge 340 at target elevation 100 thereby simplifying automation of the present invention.

Figure 5:
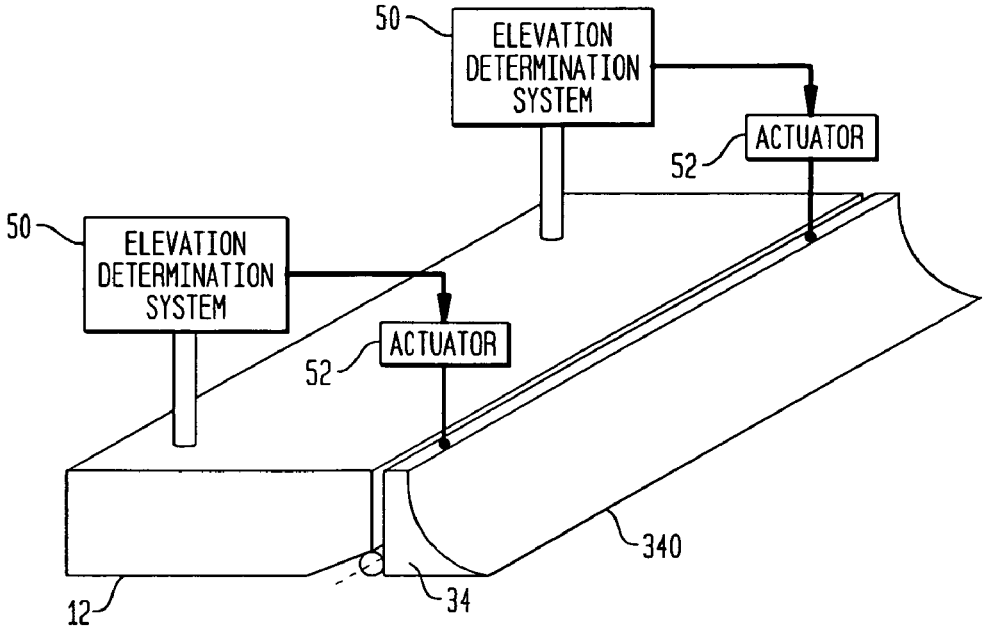
FIG. 5 is a part perspective, part schematic view of the floating screed device of FIG. 2 further equipped with a system for adjusting the pitch and twist of the screed device's movable blade.

As the length of blade 14 or 34 increases, it may be necessary to use multiple, independently-operating elevation determination systems 50 and corresponding actuators 52 (as illustrated in FIG. 5) to account for possible actual height differences between systems 50/actuators 52. The use of multiple actuators 52 allows the blade to pitch and twist as differential loads are applied by the independently-operated actuators 52. In this way, the corresponding regions of the blade can be adjusted to correct for local differences from the target height of the concrete. Note that small amounts of twist are possible even when the blades are rigid owing to the length of a typical blade (e.g., on the order of 15 feet or more).

Blade 34 (illustrated in the FIG. 2 embodiment) provides an added advantage in the present invention as arcuate face 344 defines a rake guide for concrete workers standing in the volume of plastic concrete forward of the screed device. Each of these workers watches the area just forward of blade 34 and scrapes concrete away from blade 34 when there is too much and pushes concrete towards blade 34 when there is too little. Both the scraping and pushing operations are carried out using a concrete rake (not shown), the design of which is not a limitation of the present invention. In terms of the scraping operation, arcuate face 344 facilitates raking as a rake's blade edge can follow the smooth surface of arcuate face 344. By not allowing the arc of arcuate face 344 to exceed 90°, a worker's rake can drop in easily anywhere on arcuate face 344. In addition, the planer surface of top 342 provides a landing area for a rake should a worker overshoot the top of arcuate face 344.

Blade 14 or blade 34 can be further enhanced by applying (e.g., attaching, coating, painting, etc.) one or more visual indicia on the face thereof in order to aid the concrete workers' raking operations. For example, one or more bright colors (e.g., fluorescent, neon, or any other color that is different than the concrete being finished) could be applied to the blade's face to serve as indications of when concrete needed to be scraped from or pushed toward the blade. Several possible and non-limiting examples are illustrated in FIGS. 6A-6D. While blade 34 is used as an illustrative example in FIGS. 6A-6D, it is to be understood that blade 14 could be enhanced in a similar fashion.

Figure 6A:
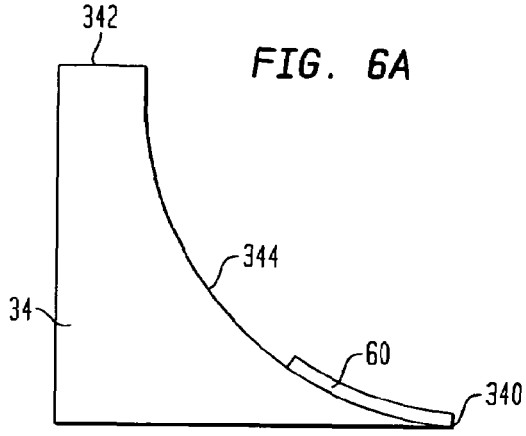
FIG. 6A is an isolated side view of the floating screed device's movable blade of FIG. 2 further having visual indicia on a lower portion of the blade's arcuate face.
Figure 6B:
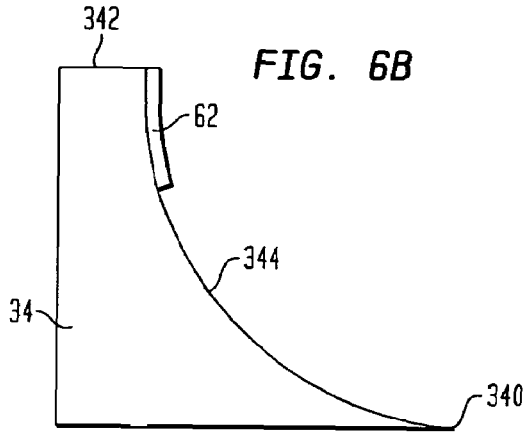
FIG. 6B is an isolated side view of the floating screed device's movable blade of FIG. 2 further having visual indicia on an upper portion of the blade's arcuate face.
Figure 6C:
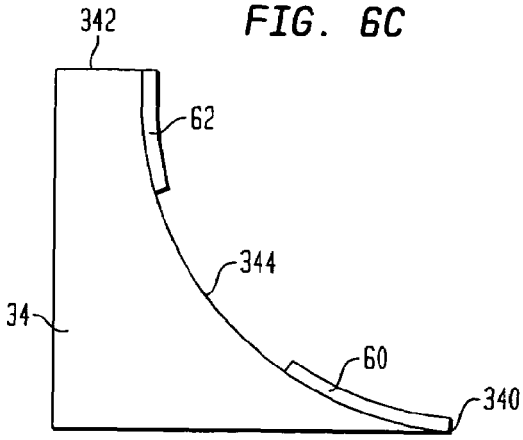
FIG. 6C is an isolated side view of the floating screed device's movable blade of FIG. 2 further having visual indicia on the upper and lower portions of the blade's arcuate face.
Figure 6D:
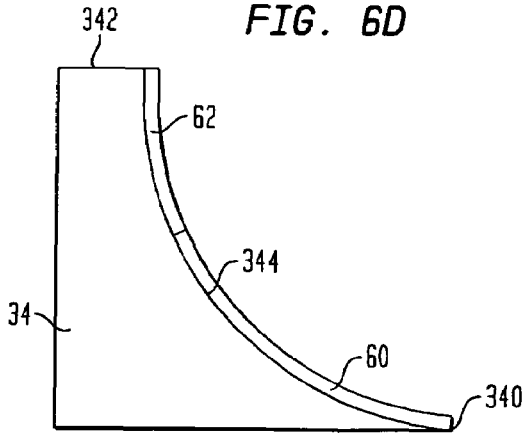
FIG. 6D is an isolated side view of the floating screed device's movable blade of FIG. 2 further having visual indicia on all of the blade's arcuate face.

In FIG. 6A, visual indicia 60 appears on arcuate face 344 in a visually continuous or discontinuous fashion in the lower region of arcuate face 344 along leading edge 340. FIG. 6B depicts visual indicia 62 on arcuate face 344 in a visually continuous or discontinuous fashion in the upper region of arcuate face 344 near top 342. In FIG. 6C, both visual indicia 60 and 62 are on arcuate face 344. In this embodiment, two different colors could be used with visual indicia 60 being one color and visual indicia 62 being a different color. The appearance of visual indicia 62 might indicate that it may soon be time to push concrete toward blade 34 whereas the appearance of visual indicia 60 would indicate that concrete needed to be immediately pushed toward blade 34. FIG. 6D is an extension of FIG. 6C in that visual indicia 60 and 62 cover the entirety of arcuate face 344. Still another option would be to provide a different visual indicia (not shown) on top 342.

Figure 7:
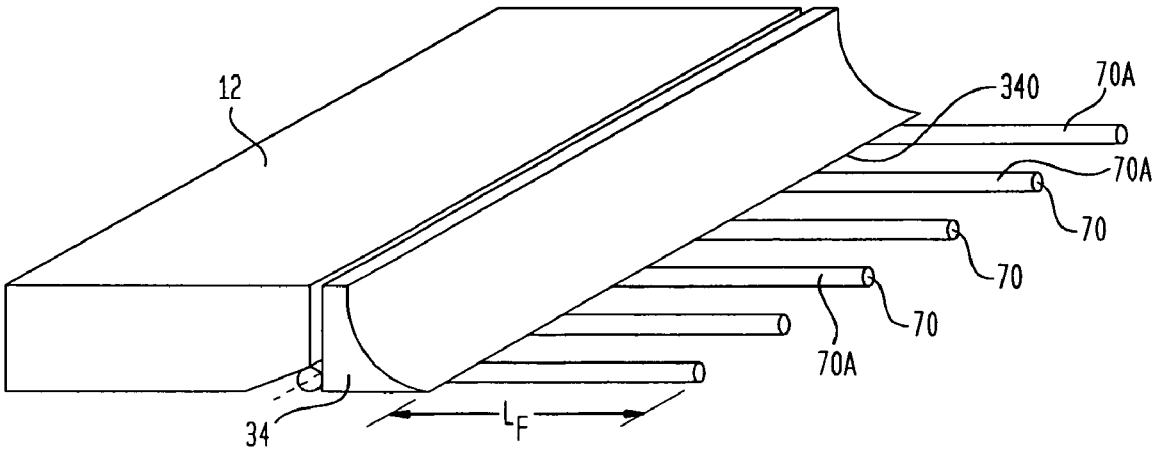
FIG. 7 is a perspective view of a floating screed device of FIG. 2 further equipped with a rake guide formed by rigid fingers extending from the blade.

Owing to the weight and density of unfinished concrete, it is necessary for the rake workers (i.e., those workers standing in the unfinished concrete forward of the screed operator) to prevent any substantial build up of unfinished concrete just ahead of the screed as this makes the screed operator's job extremely difficult. To remedy this situation, another novel type of rake guide can be added to the blade (e.g., blade 14, blade 34, or any other suitable blade structure) to provide the rake workers with a guide that would prevent concrete build up at the blade's leading edge. For example, FIG. 7 illustrates blade 34 with a plurality of rigid fingers 70 attached to blade 34 (e.g., along the underside thereof) and protruding from leading edge 340. The exposed tops 70A of fingers 70 are aligned with leading edge 340 such that tops 70A define a planar region at what will be the finish height of the concrete (not shown).

Spacing between adjacent ones of fingers 70 is such that a rake worker's blade (not shown) will rest on at least two of fingers 70 when the rake blade is placed thereon. In this way, a rake worker can pull excess concrete away from leading edge 340 at the finish height of the concrete. Further, even if the rake worker's rake stroke lands in front of leading edge 340 and on tops 70A, the rake stroke will still be completed at the finish grade of the concrete. Thus, during the raking and screeding process, the protruding length $L_F$ of fingers 70 defines a region forward of blade 34 that will be free of concrete build-up.

Length $L_F$ can be any reasonable length over which fingers 70 remain rigid. If the length of fingers 70 is such that it causes a change in the blade's balance, counter weights can be used to re-balance the blade. The shape of fingers 70 is not a limitation of the present invention. For example, the cross-sectional shape of fingers 70 can be round (as shown) or any other shape without departing from the scope of the present invention. Regardless of their shape, any minor grooves formed by fingers 70 in the unfinished concrete are quickly "floated" to the finish concrete height as float 12 (tracking behind blade 34) moves thereover.

Fingers 70 could also be colored along the length thereof in one or more colors that are different from the color of the plastic concrete being finished. Fingers 70 could just be colored all along their length or just near their outboard ends. By coloring fingers 70 in this way, the rake worker is provided with both tactile feedback (i.e., as the rake contacts fingers 70) and visual feedback.

Thus, although the invention has been described relative to a specific embodiment thereof, there are numerous variations and modifications that will be readily apparent to those skilled in the art in light of the above teachings. It is therefore to be understood that, within the scope of the appended claims, the invention may be practiced other than as specifically described.

What is claimed as new and desired to be secured by Letters Patent of the United States is:

1. A floating screed device comprising:

a first section defining a leading edge for cutting through plastic concrete;

a second section for floating on the plastic concrete;

freely pivoting hinge means for movably coupling said first section to said second section to thereby allow said leading edge to be freely moved in pitch relative to said second section; and adjusting means coupled to said first section at multiple locations along the length thereof for independently adjusting at least the pitch of said leading edge relative to a datum at each of said multiple locations as said floating screed device is moved through a volume of the plastic concrete that is unfinished with said leading edge defining an initial contact edge between said floating screed device and the volume of the plastic concrete that is unfinished.

2. A floating screed device as in claim 1 wherein said adjusting means moves said leading edge towards said datum that defines a target elevation of the plastic concrete.

3. A floating screed device as in claim 1 wherein said leading edge is blade-shaped.

4. A floating screed device as in claim 1 further comprising visual indicia applied on at least a portion of said first section.

5. A floating screed device as in claim 4 wherein said visual indicia comprises a color different from that of the plastic concrete.

6. A floating screed device as in claim 1 further comprising means coupled to said second section for determining elevation thereof relative to said datum wherein said elevation is indicative of the pitch of said first section that is required to position said leading edge on said datum.

7. A floating screed device as in claim 1 further comprising a plurality of rigid and spaced-apart fingers coupled to said first section and extending from said leading edge in a direction substantially parallel to said datum as said floating screed device is moved through a volume of plastic concrete with tops of said fingers defining a planar region aligned with said leading edge.

8. A floating screed device comprising:

an elongated float for floating on plastic concrete;

an elongated blade hingedly coupled to said elongated float wherein said elongated blade is freely movable in pitch relative to said elongated float as said elongated float floats on the plastic concrete;

means coupled to said elongated float for determining elevation thereof relative to a target elevation in the plastic concrete; and adjusting means, coupled to (i) said means for determining elevation and (ii) to said elongated blade at multiple locations along the length thereof, for independently adjusting at least the pitch of said elongated blade relative to said target elevation at each of said multiple locations based on said elevation so-determined as said floating screed device is moved through a volume of the plastic concrete that is unfinished with said elongated blade defining a leading edge of said floating screed device.

9. A floating screed device as in claim 8 further comprising visual indicia on at least a portion of said elongated blade.

10. A floating screed device as in claim 9 wherein said visual indicia comprises a color different from that of the plastic concrete.

11. A floating screed device as in claim 8 further comprising a plurality of rigid and spaced-apart fingers coupled to said elongated blade and extending therefrom in a direction substantially parallel to said target elevation as said floating screed device is moved through a volume of plastic concrete with tops of said fingers defining a planar region aligned with said elongated blade.

* * * * *